US005299626A

United States Patent [19]

Iwamoto

[11] Patent Number: 5,299,626

[45] Date of Patent: Apr. 5, 1994

[54] METHOD OF AND APPARATUS FOR INJECTION SPEED CONTROL IN DIE-CASTING MACHINE

[75] Inventor: Norihiro Iwamoto, Zama, Japan

[73] Assignee: Toshiba Kikai Kabushiki Kaisha, Tokyo, Japan

[21] Appl. No.: 28,186

[22] Filed: Mar. 9, 1993

[30] Foreign Application Priority Data

Mar. 12, 1992 [JP] Japan ..... 4-53505

[51] Int. Cl.[5] ..... B22D 17/32

[52] U.S. Cl. ..... 164/457; 164/113; 164/312; 164/155.3; 164/154.1

[58] Field of Search ..... 164/457, 4.1, 154, 155, 164/113, 312

[56] References Cited

U.S. PATENT DOCUMENTS

| | | | |
|---|---|---|---|
| 4,488,589 | 12/1984 | Moore et al. | 164/155 |
| 4,559,991 | 12/1985 | Motomura et al. | 164/155 X |
| 4,610,831 | 9/1986 | Mihara | 164/157 X |
| 4,660,620 | 4/1987 | Ozeki | 164/457 |
| 4,884,621 | 12/1989 | Ban et al. | 164/4.1 |
| 5,207,267 | 5/1993 | Iwamoto et al. | 164/457 |

FOREIGN PATENT DOCUMENTS

| | | | |
|---|---|---|---|
| 57-25272 | 2/1982 | Japan | 164/457 |
| 59-42169 | 3/1984 | Japan | 164/4.1 |
| 60-99470 | 6/1985 | Japan | 164/155 |
| 2-142664 | 5/1990 | Japan | 164/154 |

*Primary Examiner*—J. Reed Batten, Jr.

*Attorney, Agent, or Firm*—Cushman, Darby & Cushman

[57] ABSTRACT

An injection speed control valve for controlling the speed of flow of operating fluid from an operating fluid source of the die-casting machine to an injection cylinder, a pressure compensation valve for controlling the pressure of the operating fluid to a predetermined differential valve pressure to be coupled to the injection speed control valve, a bypass duct communicating the operating fluid source and the injection speed control valve, a logic valve for on-off controlling the flow of the operating fluid through the bypass duct, and a solenoid valve for on-off operating the logic valve, are provided. The speed of injection by the injection cylinder is controlled by switching the logic valve with the solenoid valve while maintaining a predetermined opening degree of the injection speed control valve.

8 Claims, 5 Drawing Sheets

METHOD OF AND APPARATUS FOR INJECTION SPEED CONTROL IN DIE-CASTING MACHINE

BACKGROUND OF THE INVENTION

1. Field of the Invention

This invention relates to a method of and an apparatus for injection speed control in a die-casting machine, utilized particularly for performing superlow speed injection employed for high quality die-cast molding.

2. Description of the Related Art

Heretofore, for obtaining forged metal products die-cast molding has been extensively utilized. In the die-cast molding, molten metal is injected into the cavity of a die by an injection plunger driven by an injection cylinder. The speed of injection is controlled by an injection speed control valve.

A usual die-cast molding is made by a standard injection process. In the process, at the beginning of the melt injection a low injection speed of about 0.3 m/sec. is set, and after the reaching of a die gate by the leading portion of the melt the injection speed is increased to about 3.0 m/sec. to quickly charge the melt into the cavity.

Meanwhile, high quality die-cast molding, for producing high mechanical strength, highly gas-tight forging, is made by a superlow speed injection process. In this process, a superlow injection speed of 0.01 to 0.5 m/sec. is set, and at the beginning of the injection the injection speed is set to 0.05 to 0.25 mm/sec. to prevent the melt in an injection sleeve from being cooled and solidified.

The standard and superlow speed injection processes have different injection speed ranges.

However, with the current injection speed control valves an extremely broad injection speed range can not be covered by merely changing the settings.

This means that the standard and superlow speed injection processes require respective exclusive injection speed control valves having different specifications.

However, installation of the exclusive die-cast machine for the individual injection processes poses problems in the installation space and installation cost. It is considered to install two different injection speed control valves in a single die-casting machine and switch these valves for the individual processes. Such a system, however, inevitably leads to complications of the control system and piping, making it difficult to elevate its utility.

An object of the invention is to provide a method of and an apparatus for injection speed control for a die-casting machine, which permit expansion of the injection speed control range of the injection speed control valve with simple means.

SUMMARY OF THE INVENTION

According to the invention, a method of injection speed control for a die-casting machine is provided, which features providing an injection speed control valve, which controls the speed of flow of operating fluid from an operating fluid source of the die-casting machine to an injection cylinder, and differential valve-pressure control means, which switches a differential valve pressure coupled to the injection speed control valve, and switching the differential valve pressure control means while maintaining a predetermined opening degree of the injection speed control valve, thereby controlling the speed of injection by the injection cylinder. The injection speed control valve is switched while maintaining a high pressure speed of the differential valve pressure control means, thereby effecting low speed injection and high speed injection in a standard injection process. The differential valve pressure control means is switched while maintaining a low speed state of the injection speed control valve, thereby effecting low speed injection and superlow speed injection in a superlow speed injection process. The operation of the standard injection process or the superlow injection process is performed by judging forcing conditions prior to the low speed injection or the high speed injection.

According to the invention, there is also provide an apparatus for injecting speed control for a die-casting machine, which features an injection rate control valve for controlling the speed of flow of operating fluid from an operating fluid source of the die-casting machine to an injection cylinder, and a differential valve pressure control means for switching a differential valve pressure coupled to the injection speed control valve. The differential pressure control means includes a pressure compensation valve for controlling the pressure of operating fluid supplied from the operating fluid source to a predetermined differential valve pressure to be coupled to the injection speed control valve, and a bypass mechanism for permitting operating fluid from the operating fluid source to be supplied without pressure control to the injection speed control valve while blocking the flow of the operating fluid in case when the operating fluid is supplied from the pressure compensation valve to the injection speed control valve. The bypass mechanism may include a bypass duct, a logic valve for on-off controlling the flow of the operating fluid through the bypass duct, and a solenoid valve for on-off controlling the logic valve. The logic valve and the solenoid valve may be replaced with a pilot operation check valve, or they may be replaced with a three-way valve.

According to the invention, as noted above, the injection speed is controlled by controlling the aperture of opening degree of the injection speed control valve, while permitting the injection speed control range increase by changing the differential valve pressure with a fixed opening degree of the injection speed control valve.

More specifically, denoting the speed of flow of the operating fluid passing through the injection speed control valve by Q, the passage sectional area (i.e., opening degree) of the valve by A, the out-flow coefficient by C and the supply pressure (i.e., differential valve pressure) on operating fluid by P, the flow speed is given as $$Q = A \times C \times P^{\frac{1}{2}}.$$

Thus, usually by holding the differential valve pressure P the opening degree A is varied to vary the flow speed Q so as to vary the speed of flow of the operating fluid into the injection cylinder, thus obtaining injection speed control.

As is understood from the above equation of the flow speed Q, by changing the valve difference pressure to 1/25, for instance, while holding the opening degree A constant, the flow speed can be changed to 1/5. This means a corresponding increase of the injection speed control range.

It is thus possible to attain the above object by covering the injection speed control range of the standard injection process by the opening degree control and covering that of the superlow speed injection process by the differential valve pressure control.

DETAILED DESCRIPTION OF THE PREFERRED EMBODIMENTS

Figure 1:
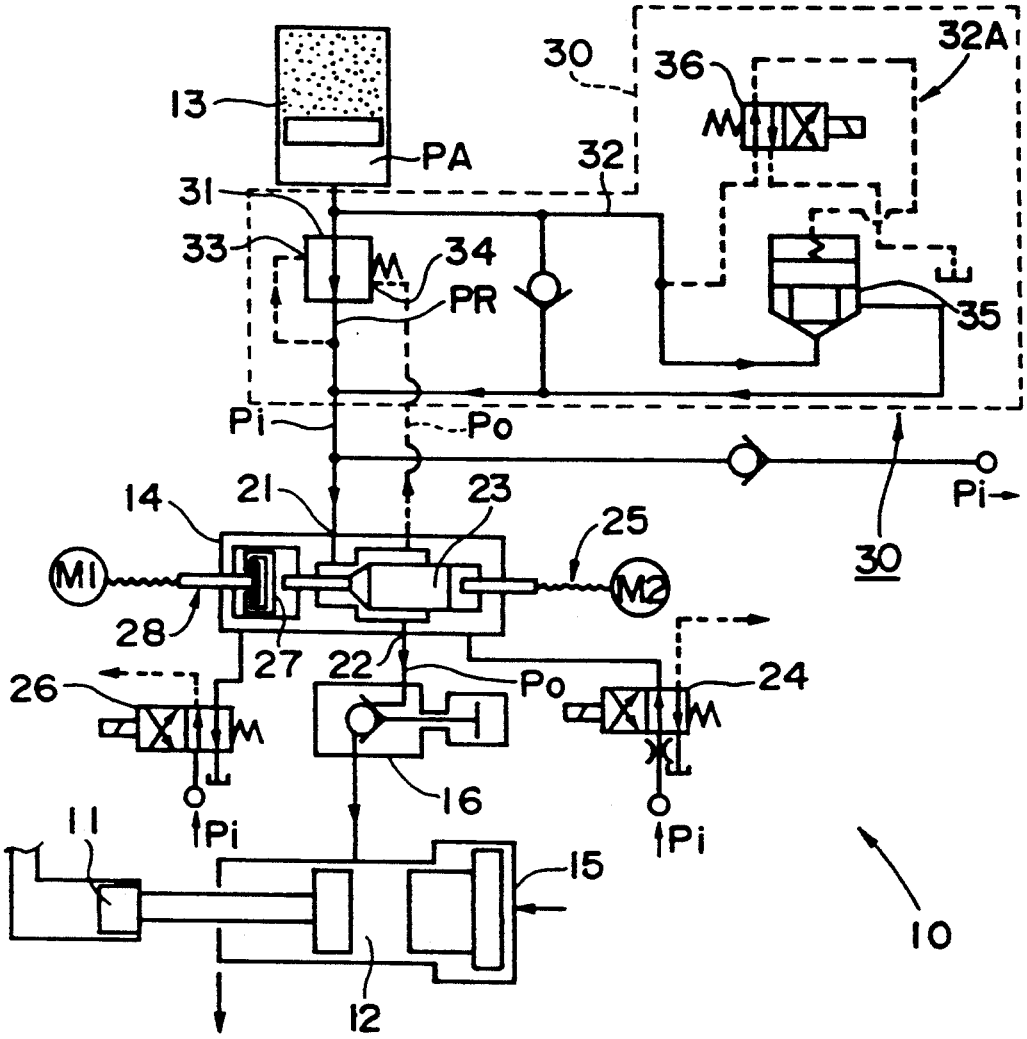
FIG. 1 is a schematic showing an embodiment of the invention.

Referring now to FIG. 1, there is shown a die-casting machine, generally designated at 10, embodying the invention. The machine comprises an injection plunger 11 for injecting molten metal into a die (not shown) and an injection cylinder 12 for driving the injection plunger 11.

For driving the injection cylinder 12, the machine 10 further comprises an accumulator 13 as an operating fluid source for supplying operating fluid under a constant pressure PA, and an injection speed control valve 14 for controlling the speed of flow of operating fluid from the accumulator 13 to the injection cylinder 12.

A boosting cylinder 15 is provided on the back side of the injection cylinder 12, and a boost check valve 16 is provided between the injection cylinder 12 and the injection speed control valve 14 to block reverse flow due to the boosting cylinder 16 at the time of the pressure application.

The injection speed control valve 14 is of a conventional type, having an inlet port 21 communicated with the accumulator 13 and an outlet port 22 communicated with the injection cylinder 12 via the boost check valve 16, the opening degrees of the ports 21 and 22 being varied according to the position of a valve body 23 in it.

The injection speed control valve 14 is fully closed by the valve body 23 with a movement thereof to the left end in the figure, caused by the supply of operating fluid, which is the same as that supplied to the inlet port 21, from a first valve 24 of solenoid type to a right side pressure chamber in the valve.

When the first valve 24 is opened, the valve body 23 is moved to the right end in the figure by the operating fluid from the inlet port 21, thus fully closing the valve 14.

The opening degree of the injection speed control valve 14 in the fully closed state thereof, can be set by restricting the rightward movement of the valve body 23 to a predetermined position with motor-driven fully-open opening degree control means 25 of contact rod type.

The valve 14 further includes a piston 27. Supply of operating fluid, which is the same as that supplied to the inlet port 21, from a second valve 26 of solenoid type to a left pressure chamber in the valve, can cause the piston 27 to be moved rightward into contact with the valve body 23, thus locking the valve body. In this way, the leftward movement of the valve body 23, caused by the first valve 24 noted above, is restricted at a position slightly before the full closure of the valve 14, that is, the valve 14 is held in a slightly open state.

The opening degree of the injection speed control valve 14 in the above slightly open state, can be set with motor-driven slightly-open opening degree control means 28 such that the rightward movement of the piston 27 is restricted at a predetermined position.

The description so far concerns a structure, in which the invention is applied to a conventional die-casting machine. In the die-casting machine 10 of this embodiment, differential valve pressure control means 30 is provided between the accumulator 13 and the injection speed control valve 14 for realizing the basic operation according to the invention.

The differential valve pressure control means 30 includes a pressure compensation valve 31 and a bypass mechanism 32A. The pressure compensation valve 31 controls the pressure of the operating fluid from the accumulator 13 to a predetermined differential valve pressure PD, under which the operating fluid is supplied to the inlet port 21 of the injection speed control valve 14. The bypass mechanism 32A can be on-off operated to permit the operating fluid from the accumulator 13 to be supplied under the original pressure PA to the inlet port 21 of the valve 14. The pressure at the inlet port 21 of the valve 14 thus is switched to high pressure in the former case and to low pressure in the latter case.

The pressure compensation valve 31 effects pressure compensation such that the difference between the pressures at two pilot pressure ports 33 and 34 is the predetermined differential valve pressure PD. To the pilot pressure ports 33 and 34 are coupled respective pressures Pi and Po at the inlet and outlet ports 21 and 22 of the injection speed control valve 14.

Thus, when operating fluid is supplied to the valve 14 through the pressure compensation valve 31, the difference between the pressures Pi and Po, i.e., the differential valve pressure PD, is controlled to be constant.

The bypass mechanism 32A includes a bypass duct 32, a logic valve 35 for on-off controlling the flow of operating fluid through the bypass duct 32, and a solenoid valve 36 for on-off controlling the logic valve 35.

When the logic valve 35 is "off", the pressure compensation valve 31 can provide effective operation to control the pressures Pi and Po at the inlet and outlet ports 21 and 22 to the fixed differential valve pressure PD which is controlled by the pressure compensation valve 31.

When the logic valve 35 is "on", on the other hand, the pressure compensation valve 31 is bypassed by the bypass duct 32. At this time, the valve 31 has no effect in operation, and the pressure Pi at the inlet port 21 is the pressure PA in the accumulator 13.

The die-casting machine 10 described above is controlled by a controller (not shown), which also controls the first and second valves 24 and 26 and solenoid valve 36 noted above.

Figure 2:
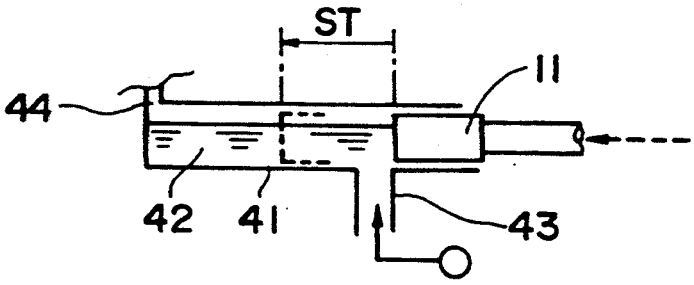
FIG. 2 is a fragmentary schematic sectional view, to an enlarged scale, showing the same embodiment.

The injection plunger 11, as shown in FIG. 2, is disposed in an injection sleeve 41 and at a position thereof behind an opening for supplying melt 42 therethrough. By the time when a die gate 44 is reached by leading portion of the melt 42 forced with advancement of the injection plunger 11 caused by the injection cylinder 12, the opening 43 is closed by the injection plunger 11 advanced to a stroke position ST.

Figure 3:
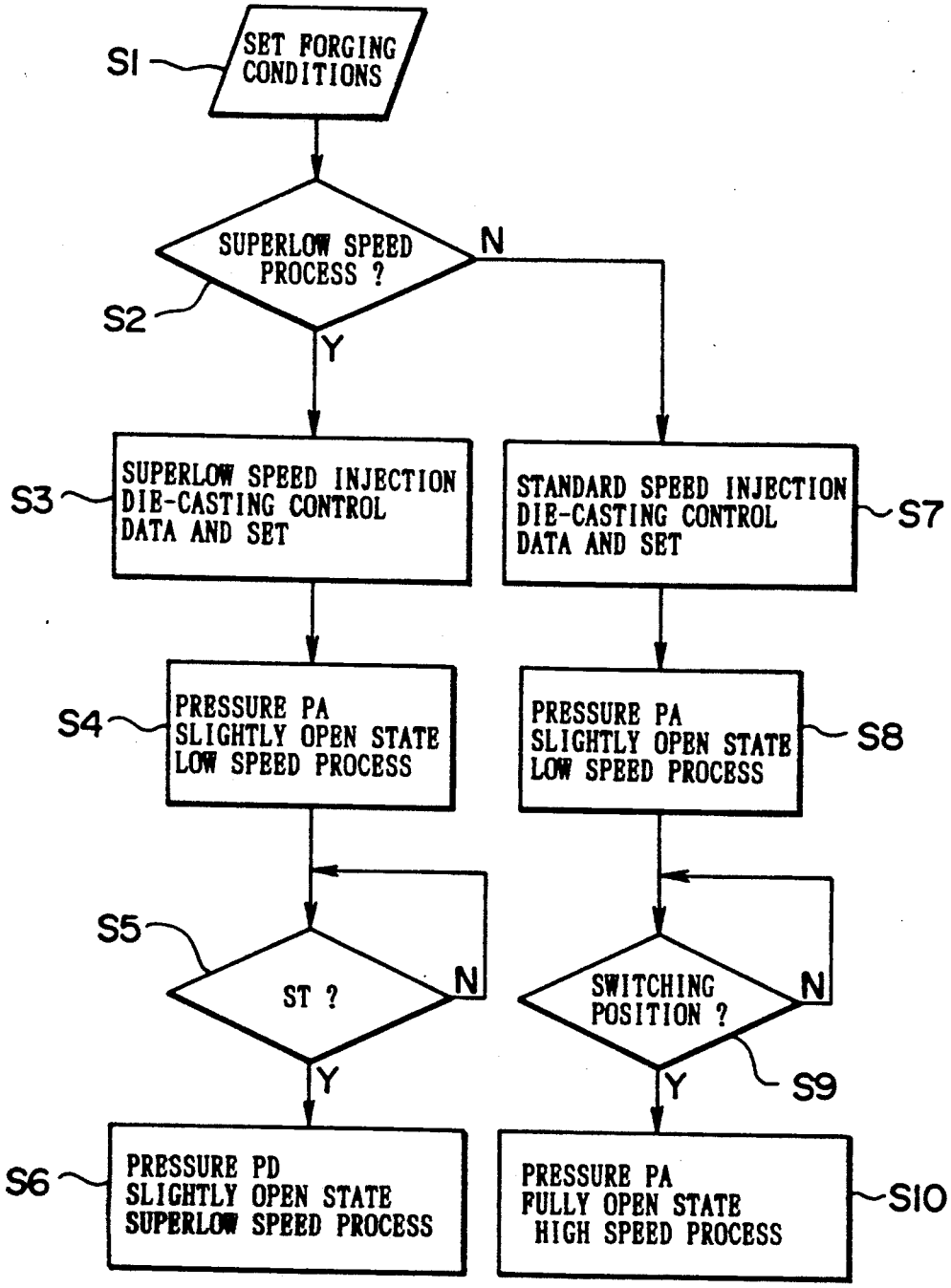
FIG. 3 is a flow chart illustrating the process in the same embodiment.

The embodiment having the above construction can perform two different operations, i.e., the standard injection process and the superlow speed injection process, in a manner as shown in FIG. 3.

Referring to the figure, in a step S1 forging conditions either by the standard process or by the suplerlow speed process are set in the controller of the die-casting machine 10.

In consequence, in a step S2 the controller judges the forging conditions and selects operation in either the standard process or the superlow speed process.

If the suplerlow process is selected, a step S3 is executed, in which the controller reads out superlow speed injection die-casting control data and sets the positions of the opening degree control means 25 and 28 and so forth according to the read-out data.

The controller then opens the solenoid valve 36 to open the logic valve 35 so as to let the pressure PA in the accumulator 13 be coupled to the injection speed control valve 14 through the bypass duct 32, while bringing about the slightly open state of the injection speed control valve 14 with the second valve 20.

As a result, a step S4 is executed, in which operating fluid is supplied at a slight speed based on the pressure PA through the injection speed control valve 14 in the slightly open state to the injection cylinder 11, thus causing the injection plunger 11 to begin advancement at a low speed V1.

Then, the controller monitors the state of advancement of the injection plunger 11 (step S5). Upon reaching of the stroke position ST, it closes the solenoid valve 36 to close the logic valve 35 so as to close the bypass duct 32, whereby the low pressure PD controlled by the pressure compensation valve 31 is supplied to the injection speed control valve 14.

Thus, operating fluid is supplied at a slight speed based on the pressure PD through the injection speed control valve 14 in the slightly open state to the injection cylinder 12, and the injection plunger 11 continues advancement at a suplerlow speed V2 (step S6).

Figure 4:
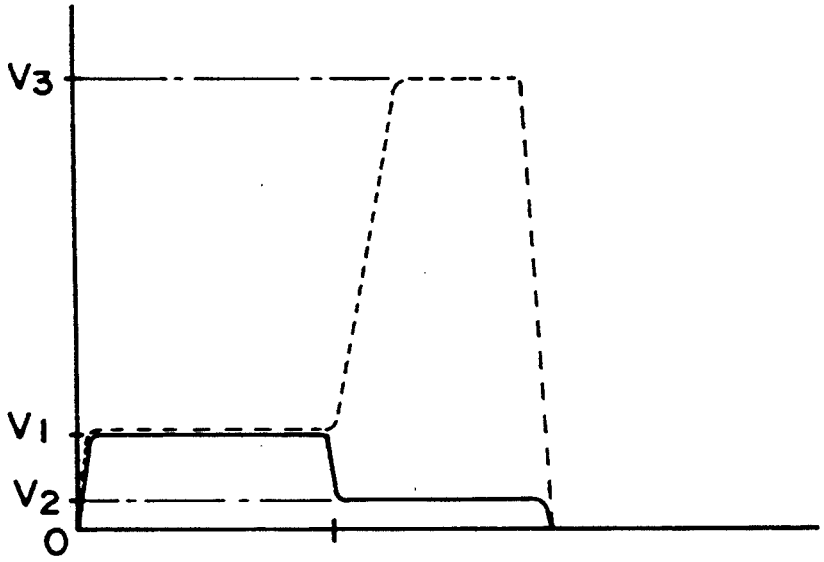
FIG. 4 is a graph illustrating the injection operation in the same embodiment.

In the above way, the suplerlow speed injection is executed. The speed of the injection cylinder 12 at this time is as shown by the solid curve in FIG. 4.

If the standard process is selected, a step S7 is executed, in which the controller of the die-casting machine 10 reads out standard injection die-casting control data and sets the positions of the opening degree control means 25 and 28 and so forth according to the read-out data.

The controller then opens the solenoid valve 30 to open the logic valve 35 so as to couple the pressure PA in the accumulator 13 to the injection speed control valve 14 through the bypass duct 32, while bringing about the slightly open state of the injection speed control valve 14 with the second valve 26.

As a result, operating fluid is supplied at a slight speed based on the pressure PA through the injection speed control valve 14 in the slightly open state to the injection cylinder 12, causing the injection plunger 11 to begin advancement at a low speed V1 (step S8).

The controller subsequently monitors the state of advancement of the injection plunger 10 (step S9), and upon reaching of a predetermined speed switching position it opens the first valve 24, thus fully opening the injection speed control valve 14.

Thus, operating fluid is supplied at a high speed based on the pressure PA through the fully open injection speed control valve 14 to the injection cylinder 12, causing continual advancement of the injection plunger 11 at a high speed V3 (step S10).

In the above way, the standard injection is executed. The speed of the injection cylinder 12 in this operation is as shown by the dashed curve in FIG. 4.

It is to be appreciated that with this embodiment, while employing the injection speed control valve 14, which provides for the low speed V1 in its slightly open state and the high speed V3 in its fully open state, under the pressure PA in the accumulator 13, the superlow speed V2 can be realized in the slightly open state of the valve 14 through pressure control to the differential valve pressure PD of the injection speed control valve 14 with the pressure compensation valve 14.

It is thus possible to realize the standard injection process, in which the low speed V1 is switched over to the high speed V3 during the injection, and the suplerlow speed injection process, in which the low speed V1 is switched over to the superlow speed V2 during the injection, can be realized by using the common injection speed control valve 14.

In addition, when executing the suplerlow speed injection process, operating fluid from the accumulator 13 is supplied to the injection cylinder 12, while the pressure compensation valve 31 controls the differential valve pressure PD between the pressures Pi and Po at the inlet and outlet ports 21 and 22 of the injection speed control valve 14 to be constant. Thus, even when the load on the injection cylinder 12 is varied, the pressure coupled to the injection cylinder 12 is automatically compensated for, thus permitting accurate injection operation to meet sufficiently the accuracy required for the suplerlow speed injection process.

When executing the standard injection process, on the other hand, the operating fluid from the accumulator 13 is supplied directly to the injection speed control valve 14 or the injection cylinder 12 via the bypass mechanism 32A. Thus, sufficient pressure and speed can be ensured to ensure the operation of the usual standard injection process.

Figure 5:
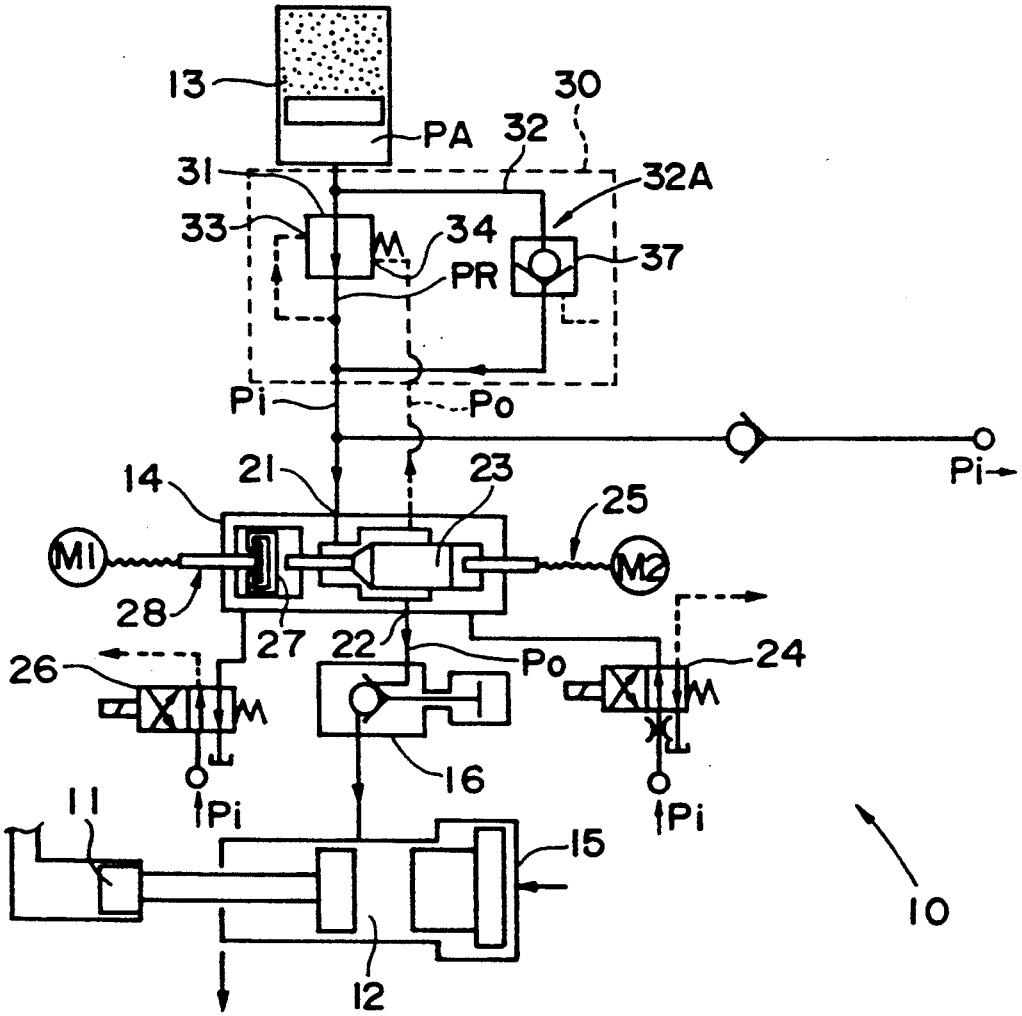
FIGS. 5 and 6 are schematics showing modifications of the same embodiment.
Figure 6:
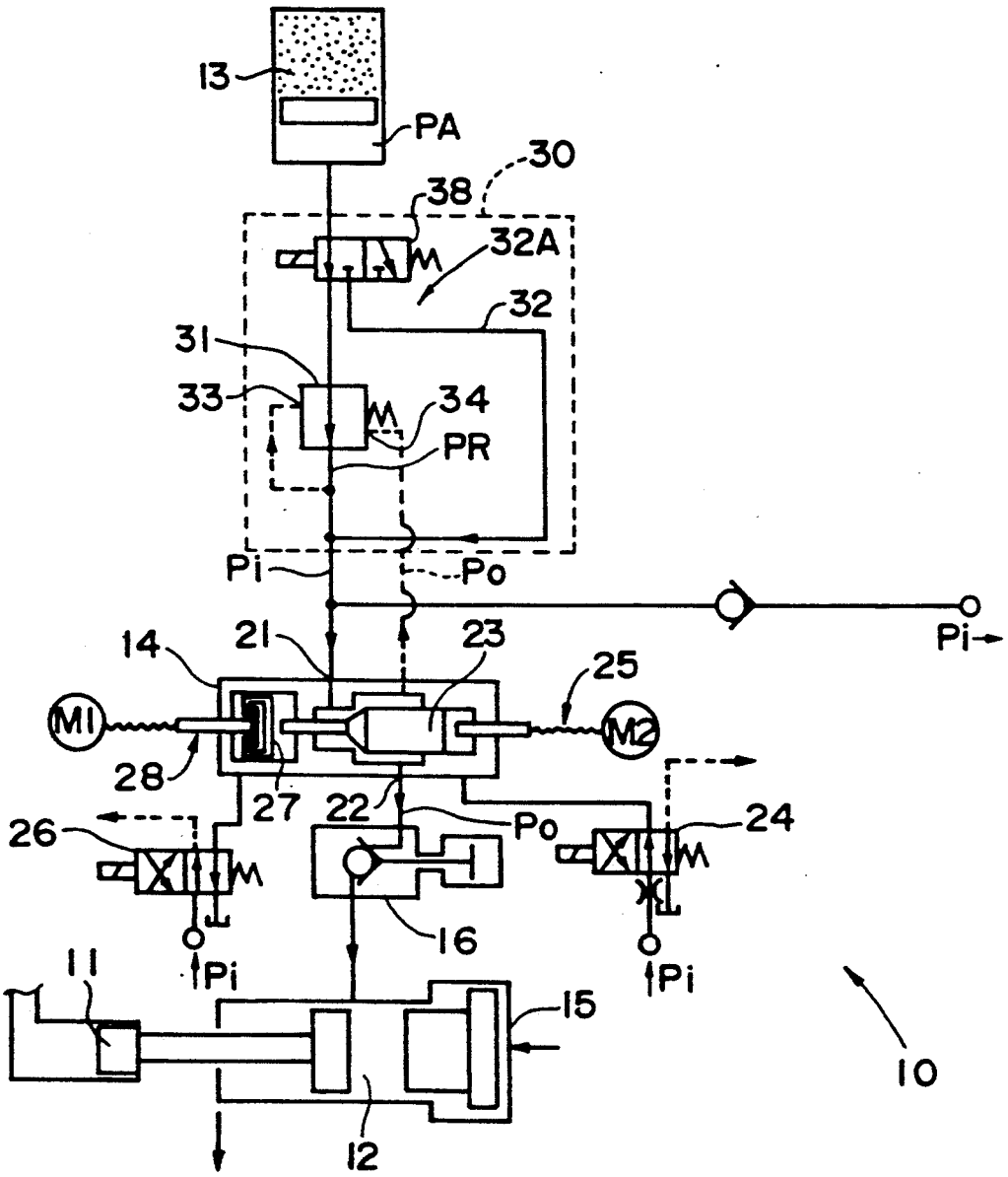

The above embodiment is by no means limitative. For example, the pressure switching in the differential valve pressure control means 30 is not limited to the on-off switching of the bypass duct 32 by the logic valve 35 to made the low pressure PD from the pressure compensation valve 31 ineffective; for instance, it is possible to use a pilot operation check valve 37 as shown in FIG. 5 may be used, or a three-way valve as shown in FIG. 6 may be used, which alternately selects the duct from the pressure compensation valve 31 and the bypass duct 32.

As has been described in the foregoing, according to the invention differential valve pressure control is provided in addition to the opening degree control by the injection speed control valve, and thus it is possible to obtain injection speed control over a range exceeding the original control range of the injection speed control valve. Thus, different injection processes greatly varying the injection speed range, such as the standard injection process and the suplerlow speed injection process, can be executed with the same die-casting machine.

What is claimed is:

1. A method of injection speed control for a die-casting machine by providing an injection speed control valve, which controls the speed of flow of operating fluid from an operating fluid source of the die-casting machine to an injection cylinder, and differential valve pressure control means, which switches a differential valve pressure coupled to said injection speed control valve, and switching said differential valve pressure control means while maintaining a predetermined opening degree of said injection speed control valve, thereby controlling the speed of injection by said injection cylinder.

2. The method according to claim 1, wherein said injection speed control valve is switched while maintaining a high pressure state of said differential valve pressure control means, thereby effecting low speed injection and high speed injection in a standard injection process, and also wherein said differential valve pressure control means is switched while maintaining a low speed state of said injection speed control valve, thereby effecting low speed injection and superlow speed injection in a superlow speed injection process.

3. The method according to claim 2, wherein the operation of said standard injection process or said superlow speed injection process is performed by judging forging conditions prior to the low speed injection and the high speed injection.

4. An apparatus for injection speed control in a die-casting machine comprising an injection speed control valve for controlling the speed of flow of operating fluid from an operating fluid source of the die-casting machine to an injection cylinder, and differential valve pressure control means for switching a differential valve pressure coupled to said injection speed control valve.

5. The apparatus according to claim 4, wherein said differential valve pressure control means includes a pressure compensation valve for controlling the pressure of operating fluid supplied from said operating fluid source to a predetermined differential valve pressure to be coupled to said injection speed control valve, and a bypass mechanism for permitting operating fluid from said operating fluid source to be supplied without pressure control to said injection speed control valve while blocking the flow of the operating fluid in case when the operating fluid is supplied from said pressure compensation valve to said injection speed control valve.

6. The apparatus according to claim 5, wherein said bypass mechanism includes a bypass duct, a logic valve for on-off controlling the flow of the operating fluid through said bypass duct, and a solenoid valve for on-off controlling said logic valve.

7. The apparatus according to claim 5, wherein said bypass mechanism incudes a bypass duct, and a pilot operation check valve for on-off controlling the flow of the operating fluid through said bypass duct.

8. The apparatus according to claim 5, wherein said bypass mechanism includes a bypass duct, and a three-way valve for on-off controlling the flow of the operating fluid through said bypass duct.

* * * * *